US005320294A

United States Patent [19]

Schmid et al.

[11] Patent Number: 5,320,294

[45] Date of Patent: Jun. 14, 1994

[54] YARN-DELIVERY DEVICE

[75] Inventors: Franz Schmid, Bodelshausen; Fritz Walker, Kusterdingen, both of Fed. Rep. of Germany

[73] Assignee: H. Stoll GmbH & Co., Fed. Rep. of Germany

[21] Appl. No.: 947,452

[22] Filed: Sep. 21, 1992

[30] Foreign Application Priority Data

Sep. 20, 1991 [DE] Fed. Rep. of Germany ..... 4131322

[51] Int. Cl.[5] ..... B65H 51/20

[52] U.S. Cl. ..... 242/47.08

[58] Field of Search ..... 242/47.08, 47.09, 47.1, 242/47.11, 47.01, 47.03, 45; 226/183

[56] References Cited

U.S. PATENT DOCUMENTS

| | | | |
|---|---|---|---|
| 2,621,390 | 12/1952 | Nield | 242/47.09 X |
| 2,641,913 | 6/1953 | Alric | 242/47.09 X |
| 3,831,873 | 8/1974 | Bense | 242/47.09 X |
| 3,912,184 | 10/1975 | Bous | 242/47.09 X |
| 5,141,170 | 8/1992 | Sarfati | 242/47.08 |

FOREIGN PATENT DOCUMENTS

| | | |
|---|---|---|
| 484053 | 7/1948 | Belgium . |
| 0387546 | 2/1990 | European Pat. Off. . |
| 2306404 | 8/1973 | Fed. Rep. of Germany . |
| 3506552 | 9/1985 | Fed. Rep. of Germany . |
| 3732102 | 5/1989 | Fed. Rep. of Germany . |
| 2071546 | 8/1971 | France . |
| 1471950 | 4/1989 | U.S.S.R. . |
| 951728 | 3/1964 | United Kingdom . |

*Primary Examiner*—Stanley N. Gilreath
*Attorney, Agent, or Firm*—Larson and Taylor

[57] ABSTRACT

In the yarn-delivery device having at least one friction cylinder (11, 12) and at least one pivoting arm (15, 16) for each yarn (20) to be delivered, the pivoting arms having at least one deflecting roller for the yarn are mounted pivotably outside the friction cylinder and are so curved that they are pivotable to behind a friction cylinder (11, 12) and a plurality of pivoting arms (15, 16) for separate yarns (20) can be arranged next to one another. (FIG. 1)

17 Claims, 3 Drawing Sheets

YARN-DELIVERY DEVICE

DESCRIPTION

Figure 1:
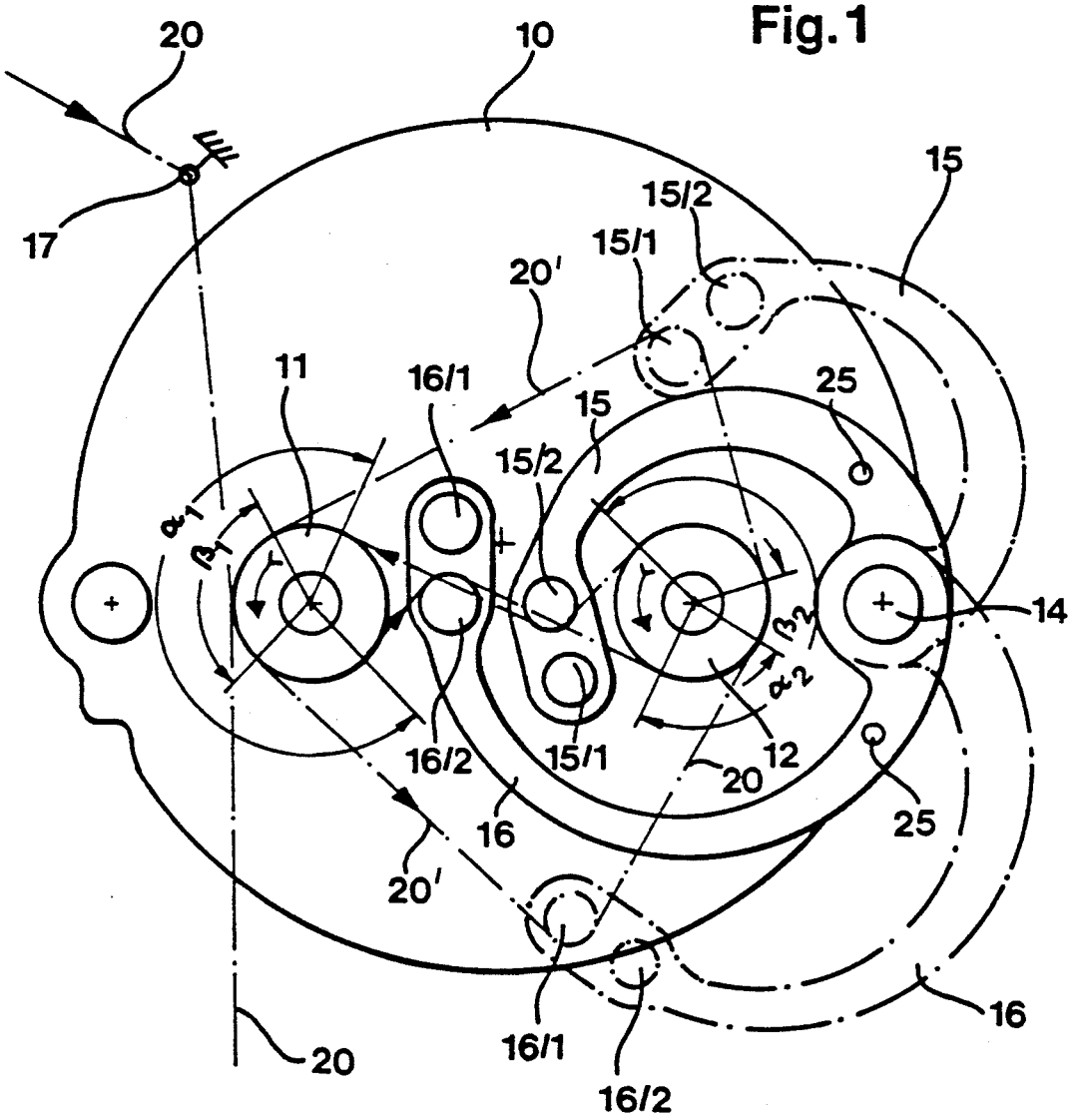

The invention relates to a yarn-delivery device having at least one driven friction cylinder, the circumferential speed of which is higher than the yarn draw-off speed, and having at least one deflecting roller which is mounted on a pivoting arm and via which the yarn is led off from the friction cylinder and the position of which determines the looping angle of the yarn around the friction cylinder.

In known friction-type yarn-delivery devices of the kind mentioned, the pivoting arm together with the deflecting roller is mounted coaxially relative to the friction cylinder (European Preliminary Publication 387,546, French Patent Specification 2,071,546). The disadvantage of this mounting of the pivoting arm together with the deflecting roller is that the range of change of the looping angle is limited and the guidance of a plurality of yarns via a friction cylinder is impeded.

The object on which the invention is based is, therefore, to design a yarn-delivery device of the kind mentioned in the introduction, in such a way that it also allows guidance and individual control of a plurality of yarns over a very wide looping-angle range.

The set object is achieved, according to the invention, in that the pivoting arm carrying the deflecting roller is curved and has a length which is greater than the diameter of the friction cylinder, and its axis extends outside the friction cylinder. Advantageously, the pivoting arm can have at its free end two yarn-deflecting rollers arranged at distance from one another and with parallel axes.

In a yarn-delivery device designed according to the invention, as many pivoting arms as desired can be arranged for guiding separate yarns via the same friction cylinder of appropriate width. The yarn-delivery device can also have two friction cylinders extending at a distance from and parallel to one another, each yarn guided via the two friction cylinders being assigned on each friction cylinder at least one yarn-guide member arranged on a pivoting arm, and the yarn-guide members all being pivotable into the clearance between the two friction cylinders. By means of the yarn-delivery device, each of a plurality of yarns can be influenced individually in its feed speed, and looping angles which can range from 0° (lift-off of the yarn from the friction cylinder) to more than 270° can be set on the friction cylinders.

The pivoting arms of the yarn-delivery device according to the invention can be arranged on a common axis extending outside an associated friction cylinder, so that, if required, they can also be coupled to one another for joint adjustment. The associated friction cylinder can advantageously be designed as a continuous long cylinder having a non-stepped surface, so that yarn rolls forming after any one of the driven yarns has broken can be pushed off via a free end of the friction cylinder after the adjacent yarns have been swung down.

A yarn-delivery device designed according to the invention is suitable especially for textile machines, for example flat knitting machines, with an automatic control of the yarn feed, the tension of the individual yarns being measured, and an adjustable motor assigned to each individual pivoting arm and engaging on it being driven in dependence on the measured yarn tension.

For each pivoting arm of the yarn-delivery device designed according to the invention, there can appropriately be limit stops which limit its pivoting range as a whole, there being arranged within the maximum looping range determined by the limit stops a continuously adjustable intermediate stop, by means of which a pivoting angle found to be favourable can be fixed in such a way that a pivoting arm, after being temporarily swung down, can be swung into this favourable position again.

An exemplary embodiment of a yarn-delivery device designed according to the invention is explained in more detail below by means of the accompanying drawing.

Figure 1A:
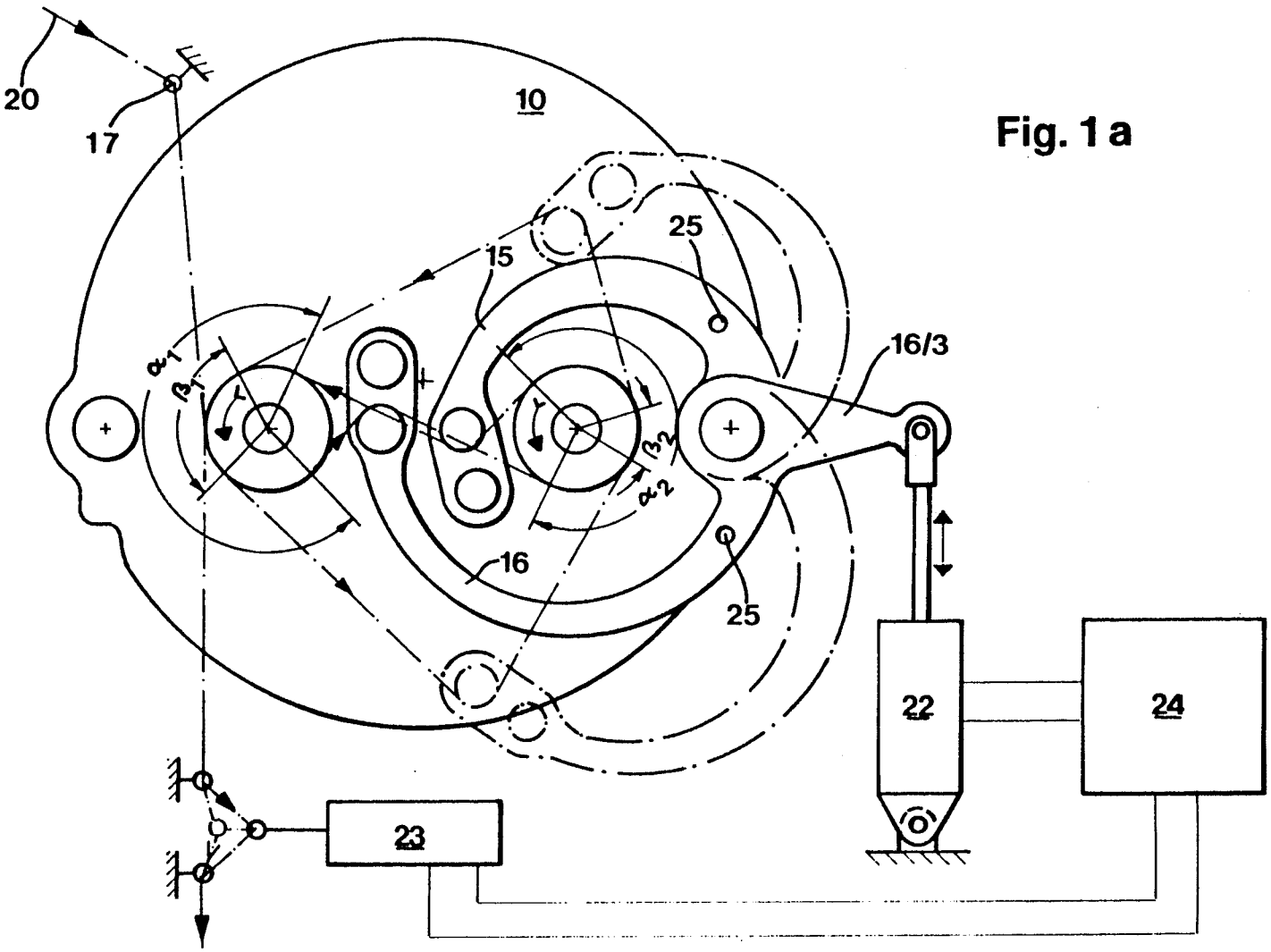
Figure 2:
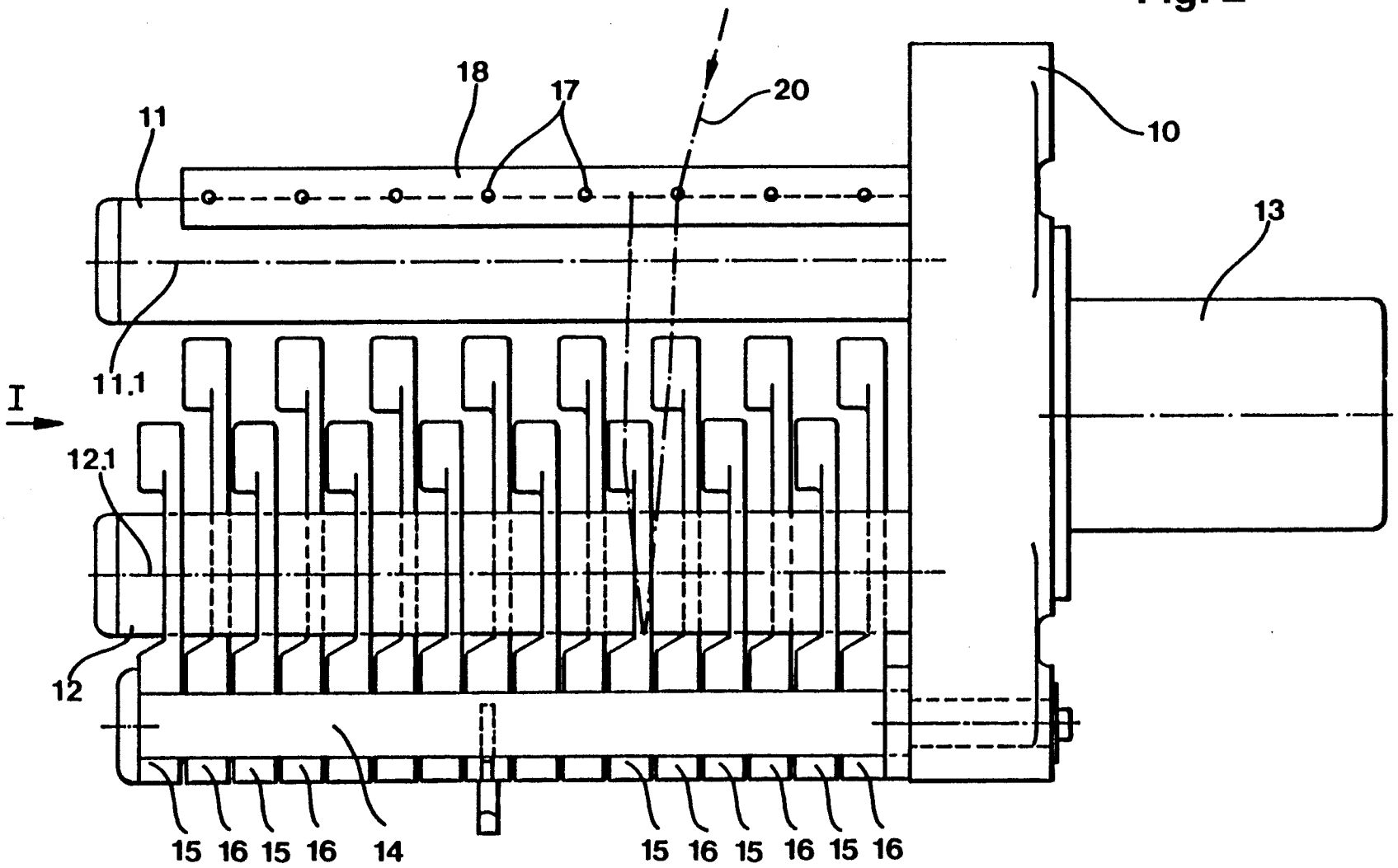

In this, in particular: FIG. 1 shows an end view of a yarn-delivery device having two friction cylinders, in the direction of the arrow I in FIG. 2; FIG. 1*a* shows a view, corresponding to that of FIG. 1, of a yarn-delivery device having a motive adjustment of the pivoting arms; FIG. 2 shows a top view of a device according to FIG. 1.

The yarn-guide device shown has a flat and essentially circular-cylindrical housing 10, in which two friction cylinders 11 and 12 projecting beyond one end face of the housing 10 and extending at a distance from and parallel to one another are mounted in an overhung manner. Flanged to the other end face of the housing 10 is an electric motor 13 which, via a gear (not shown) accommodated in the housing 10, drives the two friction cylinders 11 and 12 at a circumferential speed which is higher than a desired yarn draw-off speed. Fastened in the housing 10 at a distance from and parallel to the friction cylinder 12 is a bar 14, on which respective pluralities of two types of pivoting arms 15 and 16 are mounted alternately in succession. The pivoting arms 15 are assigned to the friction cylinder 12 and the pivoting arms 16 to the friction cylinder 11. As is evident from FIG. 1, the pivoting arms 15 and 16 are substantially longer than the diameter of the friction cylinders 11 and 12 and are so curved that, as seen from their bearing bar 14, they are pivotable into the interspace present between the two friction cylinders 11 and 12 through the common imaginary connecting plane of the axes 11.1 and 12.1 of the two friction cylinders 11, 12 without touching the friction cylinders 11, 12. Each pivoting arm 15, 16 carries at its free end two deflecting rollers 15/1, 15/2 or 16/1, 16/2 mounted at a distance and parallel to one another and freely rotatably.

The plurality of yarns to be driven are first fed to the friction cylinder 11 via a yarn-guide rail 18 evident from FIG. 2 and equipped with yarn-guide eyes 17. Only a single yarn 20 has been shown in the drawing for the sake of clarity. According to FIG. 1, the yarn passes through a yarn-guide eye 17 of the yarn-guide rail onto the friction cylinder 11. Its looping angle around the friction cylinder 11 is determined by the deflecting roller 16/2 of a pivoting arm 16, by which the yarn is led off from the friction cylinder 11 and guided to the friction cylinder 12. The looping angle alpha 2 of the yarn 20 around the friction cylinder 12 is determined by the deflecting roller 15/2 of a pivoting arm 15 adjacent to the pivoting arm 16, by which deflecting roller the yarn is lifted off from the friction cylinder 12 and guided once again to the friction cylinder 11. Finally, the yarn 20 is guided away from the friction cylinder 11 downwards to a yarn-guide member (not shown).

In FIG. 1, the two pivoting arms 15 and 16 are additionally represented by dot-and-dash lines in a second pivoting position, in which they impart to the yarn 20', also shown for this position, a respective smaller looping angle beta 1 and beta 2 around the friction cylinders 11 and 12. In this second pivoting position, the yarn 20' is guided via the deflecting rollers 15/1 and 16/1. The adjustment of the pivoting FIG. 1*a* shows an embodiment of the yarn-delivery device, in which each of the pivoting arms 15 and 16 is assigned an adjustable motor 22 engaging on a second arm, here on an arm 16/3 of a pivoting arm 16 of the pivoting arms 15 or 16. Each yarn is guided in the run-through direction behind the yarn-delivery device via a yarn-tension meter 23 which supplies a control signal to control circuit 24, from which the individual adjustable motors 22 receive their adjusting signals, for example adjusting pulses.

The drive motors can be of any suitable design. All the pivoting arms 15 and/or all the pivoting arms 16 can also be forcibly coupled to one another via a slip-on axle (not shown), for which the pivoting arms have a passage orifice 25, so that all the pivoting arms 15 or 16 are jointly adjustable, for example by means of a single drive motor 22.

We claim:

1. A device for delivering yarn comprising:

two driven friction cylinders each having a circumferential speed higher than a draw-off speed of said yarn;

two curved pivoting arms, each pivoting arm being associated with said driven friction cylinders, each pivoting arm having a length which is greater than a diameter of one of said driven friction cylinders and having a pivoting axis extending outside said driven friction cylinders; and two deflecting rollers mounted on a free end of each of said curved pivoting arms for guiding said yarn off said driven friction cylinders, wherein the position of said deflecting rollers defines a looping angle of said yarn around said driven friction cylinders and said deflecting rollers being arranged at a distance from one another and having parallel axes.

2. The device according to claim 1, said driven friction cylinders extend at a distance from and parallel to one another, said yarn being guided by said two friction cylinders via said two deflecting rollers mounted on each of said two curved pivoting arms, said deflecting rollers being pivotable into said distance between said two friction cylinders.

3. The device according to claim 2, wherein a pivoting range of said deflecting rollers extends inward at least as far as a plane common to the axis of said two friction cylinders.

4. The device according to claim 1, further comprising additional curved pivoting arms, and said friction cylinders each having a continuous long cylinder for a plurality of yarns, each yarn being assigned to two of said curved pivoting arms, said curved pivoting arms being individually adjustable.

5. The device according to claim 4, said curved pivoting arms being arranged at a distance from and parallel to one another on a common axis.

6. The device according to claim 5, said pivoting arms being coupled on said common axis to one another for simultaneous adjustment.

7. The device according to claim 1, further comprising a controllable adjustable motor coupled to said curved pivoting arms.

8. A device for delivering yarn comprising:

two driven friction cylinders each having a circumferential speed higher than a draw-off speed of said yarn, and extending at a distance from and parallel to one another;

two curved pivoting arms, each pivoting arm associated with said driven friction cylinders, each pivoting arm having a length which is greater than a diameter of one of said driven friction cylinders and having a pivoting axis extending outside said driven friction cylinders; and two deflecting rollers mounted on a free end of each of said curved pivoting arms for guiding said yarn off said driven friction cylinders, wherein the position of said deflecting rollers defines a looping angle of said yarn around said driven friction cylinders and said deflecting rollers being pivotable into said distance between said friction cylinders.

9. The device according to claim 8, wherein a pivoting range of said deflecting rollers extends inward at least as far as a plane common to the axis of said friction cylinders.

10. The device according to claim 8, said friction cylinders each having a continuous long cylinder for a plurality of yarns, each yarn being assigned to two of said curved pivoting arms, said curved pivoting arms being individually adjustable.

11. The device according to claim 10, said curved pivoting arms being arranged at a distance from and parallel to one another on a common axis.

12. The device according to claim 11, said pivoting arms being coupled on said common axis to one another for simultaneous adjustment.

13. The device according to claim 8, further comprising a controllable adjustable motor coupled to each of said curved pivoting arms.

14. A device for delivering yarn comprising:

two driven friction cylinders each having a circumferential speed higher than a draw-off speed of said yarn, and having a continuous long cylinder for a plurality of yarns;

two curved pivoting arms, each pivoting arm being associated with said driven friction cylinders, each pivoting arm having a length which is greater than a diameter of said associated driven friction cylinder and having a pivoting axis extending outside said driven friction cylinders, each yarn being assigned to said two curved pivoting arms, said curved pivoting arms being individually adjustable; and two deflecting rollers mounted on a free end of each of said curved pivoting arms for guiding said yarn off said driven friction cylinders, wherein the position of said deflecting roller defines a looping angle of said yarn around said driven friction cylinders.

15. The device according to claim 14, said curved pivoting arms being arranged at a distance from and parallel to one another on a common axis.

16. The device according to claim 15, said curved pivoting arms being coupled on said common axis to one another for simultaneous adjustment.

17. The device according to claim 14, further comprising a controllable adjustable motor coupled to each of said cruved pivoting arms.

* * * * *